US011400715B2

(12) United States Patent
Andoh et al.

(10) Patent No.: US 11,400,715 B2
(45) Date of Patent: Aug. 2, 2022

(54) LIQUID DISCHARGE HEAD, DISCHARGE DEVICE, AND LIQUID DISCHARGE APPARATUS

(71) Applicant: Ricoh Company, Ltd., Tokyo (JP)

(72) Inventors: Shiomi Andoh, Kanagawa (JP); Noritaka Masuda, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 28 days.

(21) Appl. No.: 17/060,315

(22) Filed: Oct. 1, 2020

(65) Prior Publication Data

US 2021/0114373 A1 Apr. 22, 2021

(30) Foreign Application Priority Data

Oct. 18, 2019 (JP) ..... JP2019-191385

(51) Int. Cl.
*B41J 2/14* (2006.01)

(52) U.S. Cl.
CPC .... *B41J 2/1433* (2013.01); *B41J 2002/14467* (2013.01)

(58) Field of Classification Search
CPC ..... B41J 2/1433
See application file for complete search history.

(56) References Cited

U.S. PATENT DOCUMENTS

2016/0082728 A1 3/2016 Kohda et al.
2016/0096369 A1 4/2016 Shimizu et al.
2016/0185113 A1 6/2016 Yoshida et al.
2017/0120602 A1 5/2017 Nakai et al.
2017/0157924 A1 6/2017 Otome et al.
2017/0297333 A1 10/2017 Kohda et al.
2018/0194135 A1 7/2018 Iwama et al.
2018/0257374 A1 9/2018 Yoshida et al.
2018/0272743 A1 9/2018 Nakai et al.
2019/0001689 A1* 1/2019 Ishida ..... B41J 2/17596
2019/0084303 A1* 3/2019 Sugiura ..... B41J 2/1433
2019/0084313 A1 3/2019 Kohda et al.
2020/0094573 A1 3/2020 Kohda et al.
2020/0094595 A1 3/2020 Iwama et al.

FOREIGN PATENT DOCUMENTS

JP 2015-150687 8/2015
JP 2017-077643 4/2017
JP 2018-154065 10/2018

* cited by examiner

*Primary Examiner* — Jason S Uhlenhake
(74) *Attorney, Agent, or Firm* — Xsensus LLP

(57) ABSTRACT

A liquid discharge head includes nozzles, pressure chambers, a common supply channel, a common collection channel, and an air chamber. The nozzles are configured to discharge liquid. The pressure chambers are communicated with the nozzles, respectively. The common supply channel is communicated with the pressure chambers. The common supply channel includes a displaceable first region in a part of a wall of the common supply channel. The common collection channel is communicated with the pressure chambers. The common collection channel includes a displaceable second region in a part of a wall of the common collection channel. The air chamber faces a surface of the first region and a surface of the second region. The surface of the first region is opposite the wall of the common supply channel. The surface of the second region is opposite the wall of the common collection channel.

14 Claims, 8 Drawing Sheets

LIQUID DISCHARGE HEAD, DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-191385, filed on Oct. 18, 2019, in the Japan Patent Office, the entire disclosure of which is hereby incorporated by reference herein.

BACKGROUND

Technical Field

Embodiments of the present disclosure relate to a liquid discharge head, a discharge device, and a liquid discharge apparatus.

Related Art

In a liquid discharge head that discharges liquid, discharge characteristics vary due to residual vibration that occurs as the liquid is discharged.

For example, there is known a head in which thin film portions are formed in portions in which both of a supply channel and a circulation channel communicated with a pressure chamber are opposed to each other, and a space portion is formed between the thin film portions.

SUMMARY

In an aspect of the present disclosure, there is provided a liquid discharge head that includes nozzles, pressure chambers, a common supply channel, a common collection channel, and an air chamber. The nozzles are configured to discharge liquid. The pressure chambers are communicated with the nozzles, respectively. The common supply channel is communicated with the pressure chambers. The common supply channel includes a displaceable first region in a part of a wall of the common supply channel. The common collection channel is communicated with the pressure chambers. The common collection channel includes a displaceable second region in a part of a wall of the common collection channel. The air chamber faces a surface of the first region and a surface of the second region. The surface of the first region is opposite the wall of the common supply channel. The surface of the second region is opposite the wall of the common collection channel.

In an aspect of the present disclosure, there is provided a liquid discharge head that includes a plurality of nozzles, a plurality of pressure chambers, a common supply channel, a common collection channel, a first region, and a second region. The plurality of nozzles are configured to discharge liquid. The plurality of pressure chambers are communicated with the nozzles, respectively. The common supply channel is communicated with the pressure chambers. The common collection channel is communicated with the pressure chambers. The air chamber is located between the common supply channel and the common collection channel. The first region separates the common supply channel from the air chamber. The second region separates the common collection channel from the air chamber. The air chamber, a part of the common supply channel; and the common collection channel overlap each other in a direction perpendicular to a nozzle surface of the liquid discharge head, in still another aspect of the present disclosure, there is provided a discharge device including the liquid discharge head according to any of the above-described aspects.

In still yet another aspect of the present disclosure, there is provided a liquid discharge apparatus including the discharge device.

In still further yet another aspect of the present disclosure, there is provided a liquid discharge apparatus including the liquid discharge head according to any of the above-described aspects.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 10 is a side view of the main part of the liquid discharge apparatus illustrated in

FIG. 9;

Figure 1:
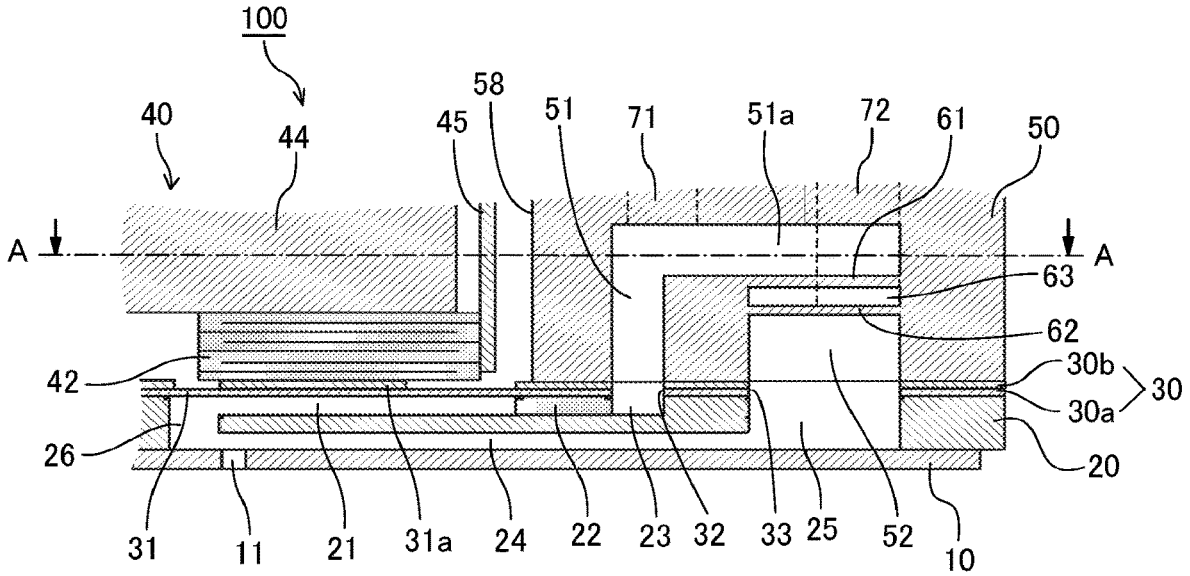
FIG. 1 is a cross-sectional view of a liquid discharge head according to a first embodiment of the present disclosure, taken along a direction orthogonal to a nozzle arrangement direction.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
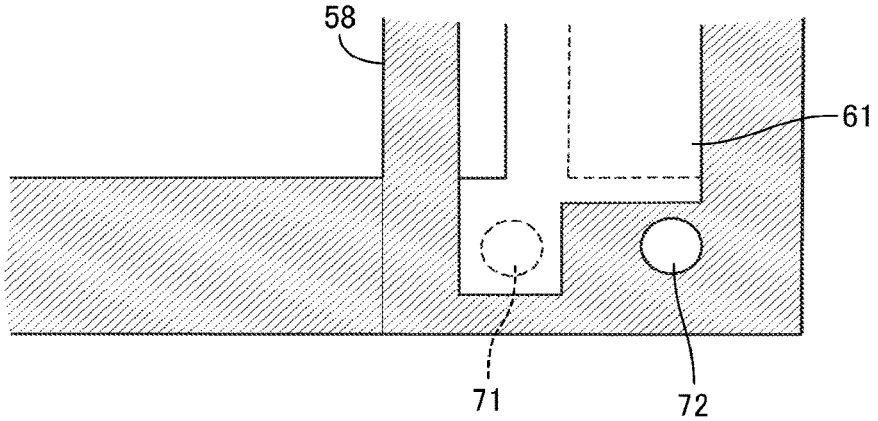
FIG. 2 is a cross-sectional view of the liquid discharge head taken along line A-A of FIG. 1.

Below, embodiments of the present disclosure are described with reference to the attached drawings. A first embodiment of the present disclosure is described with reference to FIGS. 1 and 2. FIG. 1 is a cross-sectional view of a liquid discharge head according to the first embodiment, taken along a direction (pressure-chamber longitudinal direction) orthogonal to a nozzle arrangement direction of the liquid discharge head. FIG. 2 is a cross-sectional view of the liquid discharge head taken along line A-A of FIG. 1.

A liquid discharge head 100 according to the present embodiment includes a nozzle plate 10, a channel plate 20, and a diaphragm member 30 as a wall member that are stacked (or laminated) and bonded. Note that hereinafter the liquid discharge head may be referred to as head. The liquid discharge head 100 further includes a piezoelectric actuator 40 to displace a vibration region (diaphragm) 31 of the diaphragm member 30 and a common channel substrate 50 that also serves as a frame substrate of the liquid discharge head 100.

The nozzle plate 10 includes a plurality of nozzles 11 to discharge liquid.

The channel plate 20 forms a plurality of pressure chambers 21 respectively communicated with the plurality of nozzles 11 via nozzle communication paths 26, individual supply channels 22 respectively communicated with the pressure chambers 21 and also serving as fluid restrictors, and intermediate supply channels 23 serving as liquid introduction portions communicated with one or more individual supply channels 22.

The channel plate 20 forms a plurality of individual collection channels 24 respectively communicated with the plurality of pressure chambers 21, and one or a plurality of intermediate collection channels 25 serving as one or a plurality of liquid lead-out portions communicated with one or more individual collection channels 24.

The diaphragm member 30 has a plurality of displaceable vibration regions (diaphragms) 31 that form wall surfaces of the pressure chambers 21 of the channel plate 20. Here, the diaphragm member 30 has a two-layer structure and includes a first layer 30A forming a thin portion and a second layer 30B forming a thick portion in this order from a side facing the channel plate 20. Note that the structure of the diaphragm member is not limited to such a two-layer structure but may be any suitable layer structure.

The piezoelectric actuator 40 including an electromechanical transducer element serving as a driving device (an actuator device or a pressure generator device) to deform the vibration region 31 of the diaphragm member 30 is disposed on a side of the vibration region 31 of the diaphragm member 30 opposite a side facing the pressure chamber 21.

In the piezoelectric actuator 40, a piezoelectric member bonded on the base 44 is grooved by half-cut dicing, to form a desired number of columnar piezoelectric elements 42 at predetermined intervals in a comb shape. The piezoelectric element 42 is bonded to a convex portion 31*a* that is an island-shaped thick portion in the vibration region 31 of the diaphragm member 30.

The piezoelectric element 42 includes piezoelectric layers and internal electrodes alternately laminated on each other. Each internal electrode is led out to an end surface and connected to an external electrode (end surface electrode). The external electrode is connected with a flexible wiring member 45.

The common channel substrate 50 forms a common supply channel 51 communicated with the plurality of pressure chambers 21. The common supply channel 51 is communicated with the intermediate supply channel 23 via an opening 32 provided in the diaphragm member 30 and is communicated with the individual supply channel 22 via the intermediate supply channel 23.

The common channel substrate 50 forms a common collection channel 52 communicated with the plurality of pressure chambers 21. The common collection channel 52 is communicated with the intermediate collection channel 25 via an opening 33 provided in the diaphragm member 30 and is communicated with the individual collection channel 24 via the intermediate collection channel 25.

The common channel substrate 50 includes a supply port 71 through which liquid is supplied from the outside through the common supply channel 51 and a collection port 72 through which liquid is collected from the outside through the common collection channel. The common channel substrate 50 includes a groove portion 58 into which the piezoelectric actuator 40 is inserted.

In the head 100, for example, the voltage to be applied to the piezoelectric element 42 is lowered from a reference potential (intermediate potential) so that the piezoelectric element 42 contracts to pull the vibration region 31 to increase the volume of the pressure chamber 21, As a result, liquid flows into the pressure chamber 21.

Then, the voltage to be applied to the piezoelectric element 42 is increased to expand the piezoelectric element 42 in a direction of lamination. The vibration region 31 is deformed in a direction toward the nozzle 11 to reduce the volume of the pressure chamber 21. As a result, the liquid in the pressure chamber 21 is pressurized and discharged from the nozzle 11.

Next, a description is given of a vibration damping structure in the present embodiment.

The common supply channel 51 has a displaceable first region 61 in a part of a wall of the common supply channel 51. The common collection channel 52 has a displaceable second region 62 in a part of a wall of the common collection channel 52. Both of a surface of the first region 61 on a side opposite to a side facing the common supply channel 51 and a surface of the second region 62 on a side opposite to a side facing the common collection channel 52 face an air chamber 63 that is a common gas chamber.

In the present embodiment, the common supply channel 51 and the common collection channel 52 are arranged side by side in the longitudinal direction of the pressure chamber 21 (i.e., the direction orthogonal to the nozzle arrangement direction). A portion of the common supply channel 51 extends in the direction orthogonal to the nozzle arrangement direction to the side of the common collection channel 52, and forms an overlapping portion 51*a* overlapping the common collection channel 52 in a direction perpendicular to the nozzle surface (i.e., the surface of the nozzle plate 10).

The first region 61 is disposed at the overlapping portion 51*a* of the common supply channel 51, and the second region 62 is disposed at a portion of the common collection channel 52 facing the first region 61 via the air chamber 63.

With such a configuration, the pressure wave generated when the liquid in the pressure chamber 21 is pressurized and the liquid is discharged from the nozzle 11 is propagated to the common supply channel 51 and the common collection channel 52. Accordingly, the pressure wave is attenuated by the displacement of the first region 61 and the second region 62, and stable discharge characteristics are obtained.

In the present embodiment, a portion of the common supply channel 51 is extended to form the overlapping portion 51*a* overlapping with the common collection channel 52 in the direction perpendicular to the nozzle surface. The first region 61 and the second region 62 are arranged to face a common air chamber 63 serving as an air chamber.

Accordingly, even when the width of the common supply channel 51 in the direction orthogonal to the nozzle arrangement direction is increased, the width of the head 100 is not increased. Thus, the areas of the first region 61 and the second region 62 serving as dampers can be increased while restraining an increase in the size of the head 100, thus allowing enhancement of the vibration damping effect. In addition, the channel volume of the common supply channel 51 can also be ensured.

Figure 3:
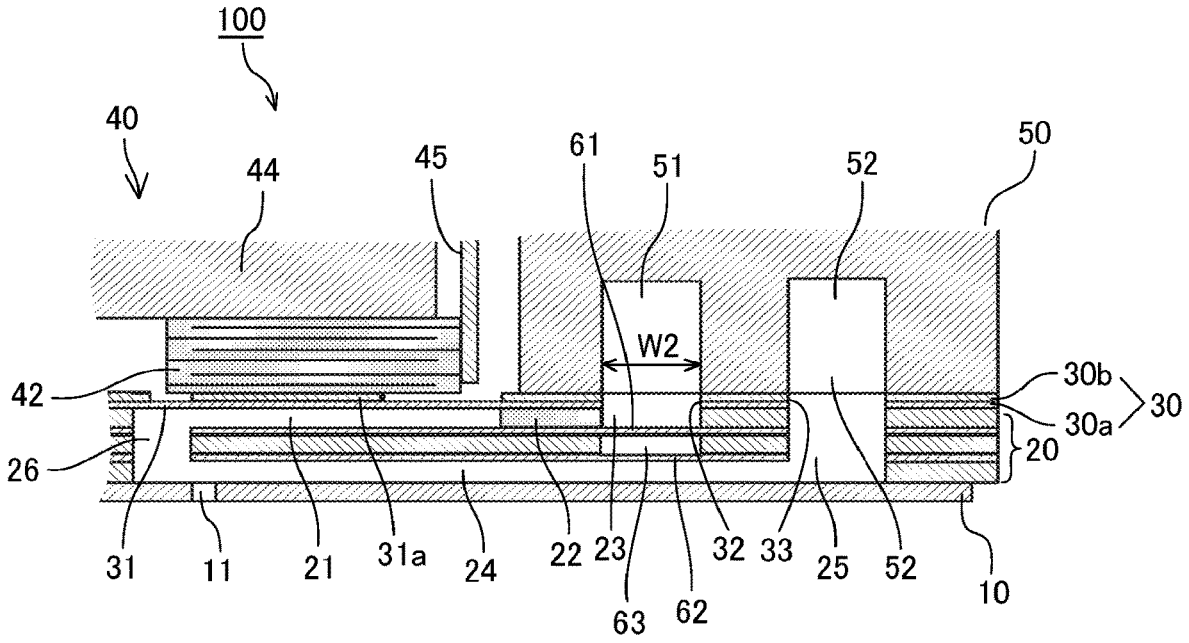
FIG. 3 is a cross-sectional view of a liquid discharge head according to Comparative Example 1, taken along a direction orthogonal to a nozzle arrangement direction.

Here, Comparative Example 1 is described with reference to FIG. 3. FIG. 3 is a cross-sectional view of a liquid discharge head according to Comparative Example 1, taken along a direction (pressure-chamber longitudinal direction) orthogonal to a nozzle arrangement direction.

In Comparative Example 1, a first region 61 and a second region 62 are disposed on a wall of an intermediate supply channel 23 and a wall of an individual collection channel 24, respectively, which overlap in a direction perpendicular to a nozzle surface, and the first region 61 and the second region 62 face a common air chamber 63 as a common gas chamber.

In Comparative Example 1, in order to enhance the damping effect by increasing the area of the first region 61, it is necessary to increase the width W2 of a common supply channel 51 in the direction orthogonal to the nozzle arrangement direction. However, when the width W2 of the common supply channel 51 is increased, the width of the head 100 is increased and the size of the head is increased.

Therefore, if the width of the head 100 is the same, the width of the first region 61 becomes relatively narrow, and a sufficient vibration damping effect may bot be obtained.

Hence, according to the present embodiment, as described above, the vibration damping effect can be enhanced while restraining an increase in the size of the head 100.

Figure 4:
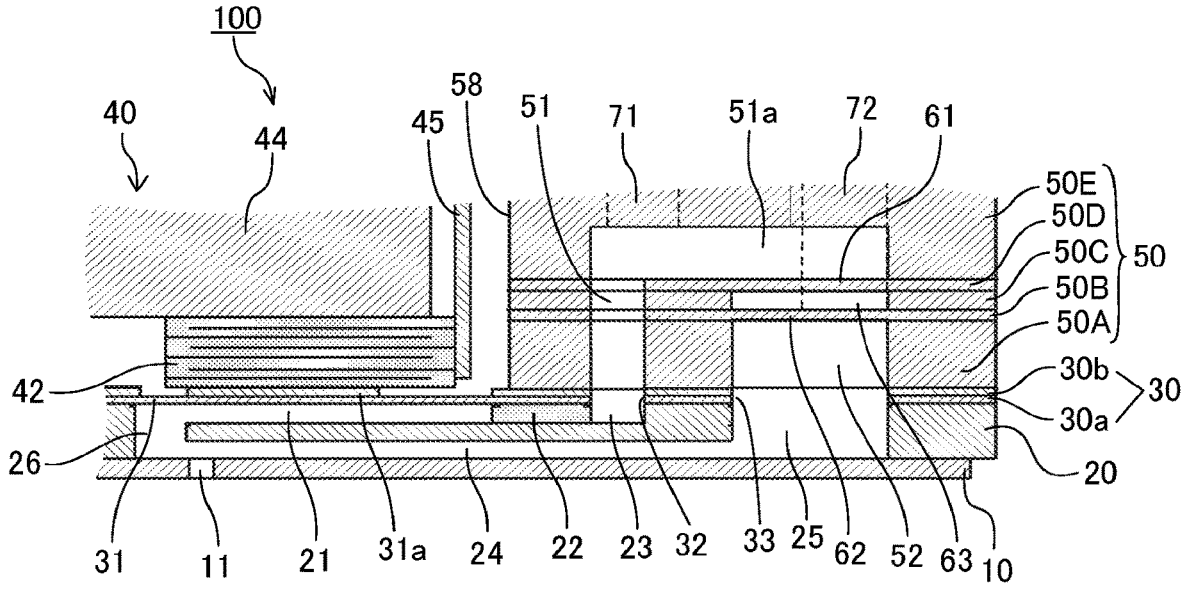
FIG. 4 is a cross-sectional view of a liquid discharge head according to a second embodiment of the present disclosure, taken along a direction orthogonal to a nozzle arrangement direction.

Next, a second embodiment of the present disclosure is described with reference to FIG. 4. FIG. 4 is a cross-sectional view of a liquid discharge head according to the second embodiment, taken along a direction (pressure-chamber longitudinal direction) orthogonal to a nozzle arrangement direction of the liquid discharge head.

A common channel substrate 50 includes a plurality of plate members 50A to 50E laminated one on another. The plurality of plate members 50A to 50E are bonded by, for example, diffusion bonding.

Here, a second region 62 is formed with the plate member 50B, a first region 61 is formed with the plate member SOD, and an air chamber 63 is formed with the plate member 50C. The plate member 50A has a through portion serving as a part of a common supply channel 51 and a common collection channel 52. The plate members 50B to 50D also have a through portion serving as a part of the common supply channel 51. The plate member 50E has a concave portion that forms the common supply channel 51 including an overlapping portion 51*a*.

As described above, the common channel substrate 50 includes the plurality of plate members 50A to 50E laminated one on another, thus allowing the first region 61, the second region 62, and the common air chamber 63 to be easily formed.

Figure 5:
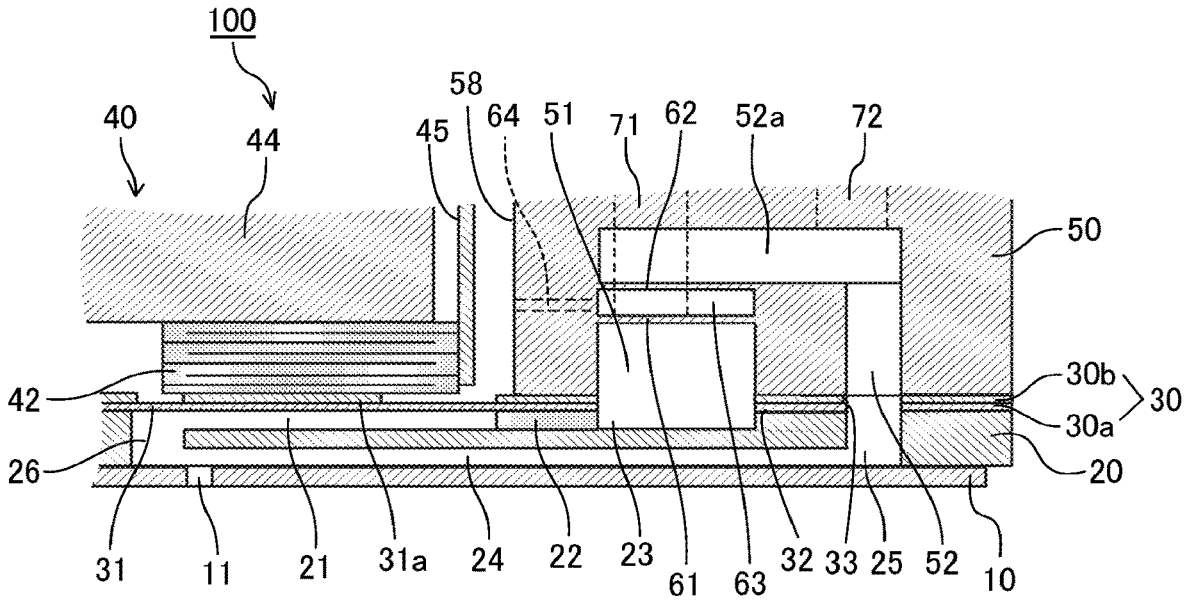
FIG. 5 is a cross-sectional view of a liquid discharge head according to a third embodiment of the present disclosure, taken along a direction orthogonal to a nozzle arrangement direction.

Next, a third embodiment of the present disclosure is described with reference to FIG. 5. FIG. 5 is a cross-sectional view of a liquid discharge head according to the third embodiment, taken along a direction (pressure-chamber longitudinal direction) orthogonal to a nozzle arrangement direction of the liquid discharge head.

In the present embodiment, a common supply channel 51 and a common collection channel 52 are arranged side by side in a longitudinal direction of a pressure chamber 21 (i.e., the direction orthogonal to the nozzle arrangement direction). A portion of the common collection channel 52 extends in the direction orthogonal to the nozzle arrangement direction to the side of the common supply channel 51, and forms an overlapping portion 52*a* overlapping the common supply channel 51 in a direction perpendicular to a nozzle surface (i.e., a surface of a nozzle plate 10).

A second region 62 is disposed at the overlapping portion 52*a* of the common collection channel 52, and a first region 61 is disposed at a portion of the common supply channel 51 facing the second region 62 via an air chamber 63.

A common channel substrate 50 includes an atmosphere communication path 64 communicated with the air chamber 63. The atmosphere communication path 64 is disposed in a groove portion 58 in which a piezoelectric actuator 40 provided in the common channel substrate 50 is disposed.

Such a configuration of communicating the air chamber 63 with the atmosphere can obviate the consideration of the compliance of air in the air chamber 63. Thus, a large pressure propagation absorption effect (damping effect) can be obtained.

In addition, the atmosphere communication path 64 is communicated with the inner groove portion 58 instead of the outer surface of the common channel substrate 50 constituting a frame of the head 100. Such a configuration can prevent liquid from entering the air chamber 63.

In such a case, the air chamber 63 is disposed on the side of the common supply channel 51 close to the groove portion 58 in which the piezoelectric actuator 40 provided in the common channel substrate 50 is disposed. Thus, the atmosphere communication path 64 can be easily routed to the groove portion 58. That is, as in the first embodiment, when the air chamber 63 is disposed on the side of the common collection channel 52 far from the groove portion 58, it is necessary to route the atmosphere communication path 64 to an end portion in the nozzle arrangement direction in order to communicate with the groove portion 58, thus causing an increased, distance.

Figure 6:
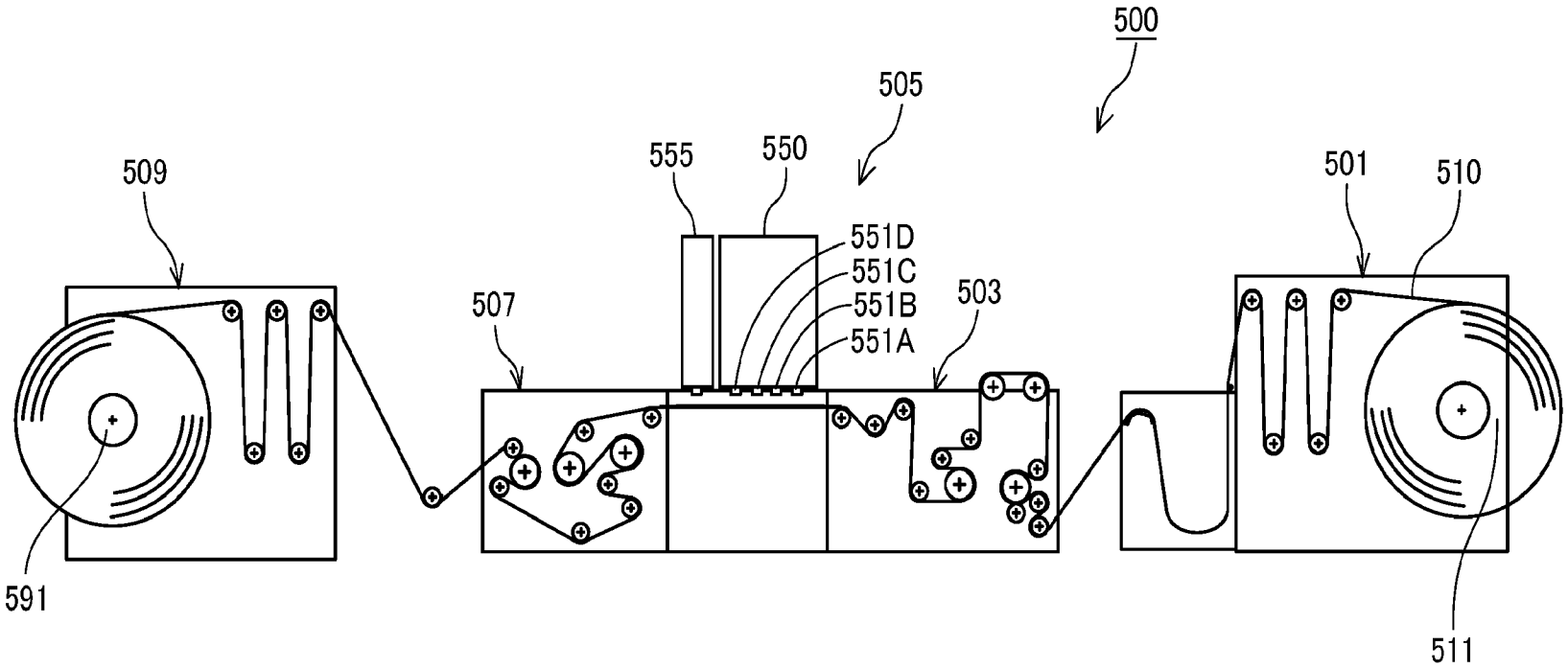
FIG. 6 is a schematic side view of a liquid discharge apparatus according to an embodiment of the present disclosure.
Figure 7:
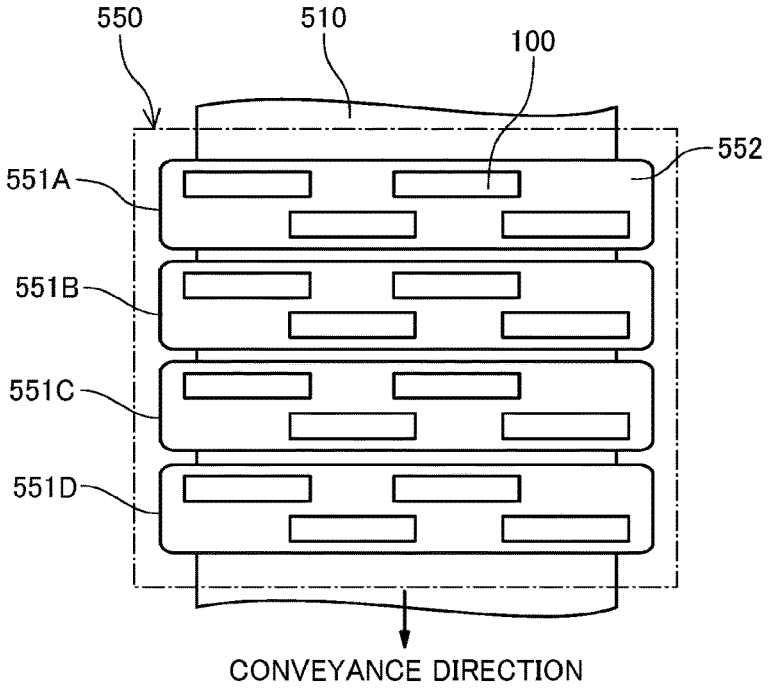
FIG. 7 is a plan view of a head unit of the printing apparatus according to an embodiment of the present disclosure.

Next, a liquid discharge apparatus according to an embodiment of the present disclosure is described with reference to FIGS. 6 and 7. FIG. 6 is a schematic view of the liquid discharge apparatus according to the present embodiment. FIG. 7 is a plan view of a head unit of the liquid discharge apparatus.

A printing apparatus 500 serving as the liquid discharge apparatus according to the present embodiment includes, e.g., a feeder 501, a guide conveyor 503, a printer 505, a drier 507, and a carrier 509. The feeder 501 feeds a continuous medium (or a web) 510 inward. The guide conveyor 503 guides and conveys the continuous medium 510 such as a continuous sheet of paper or a sheet medium ted inward from the feeder 501. The printer 505 performs printing by discharging liquid onto the conveyed continuous medium 510 to form an image. The drier 507 dries the continuous medium 510 with the image formed. The carrier 509 feeds the dried continuous medium 510 outward.

The continuous medium 510 is sent out from an original winding roller 511 of the feeder 501, is guided and conveyed by rollers of the feeder 501, the guide conveyor 503, the drier 507, and the carrier 509, and is wound up by a wind-up roller 591 of the carrier 509.

In the printer 505, the continuous medium 510 is conveyed on a conveyance guide 559 so as to face a discharge unit 550 and a discharge unit 555. An image is formed with the liquid discharged from the discharge unit 550, and post-processing is performed with the processing liquid discharged from the discharge unit 555.

In the discharge unit 550, for example, full-line head arrays 551A, 551B, 551C, and 551D for four colors (hereinafter referred to as the "head arrays 551" unless the colors distinguished) are arranged in this order from the upstream side in a direction of conveyance of the continuous medium 510.

The head arrays 551A, 551B, 551C, and 551D are liquid dischargers to discharge liquids of, for example, black (K), cyan (C), magenta (M), and yellow (Y), respectively, onto the continuous medium 510 being conveyed. Note that the type and number of colors are not limited to the above-described example.

In the head array 551, for example, the liquid discharge heads 100 according to an embodiment of the present disclosure are arranged in a staggered manner on a base 552. Note that embodiments of the present disclosure are not limited to the arrangement and may be any other suitable head arrangement.

Figure 8:
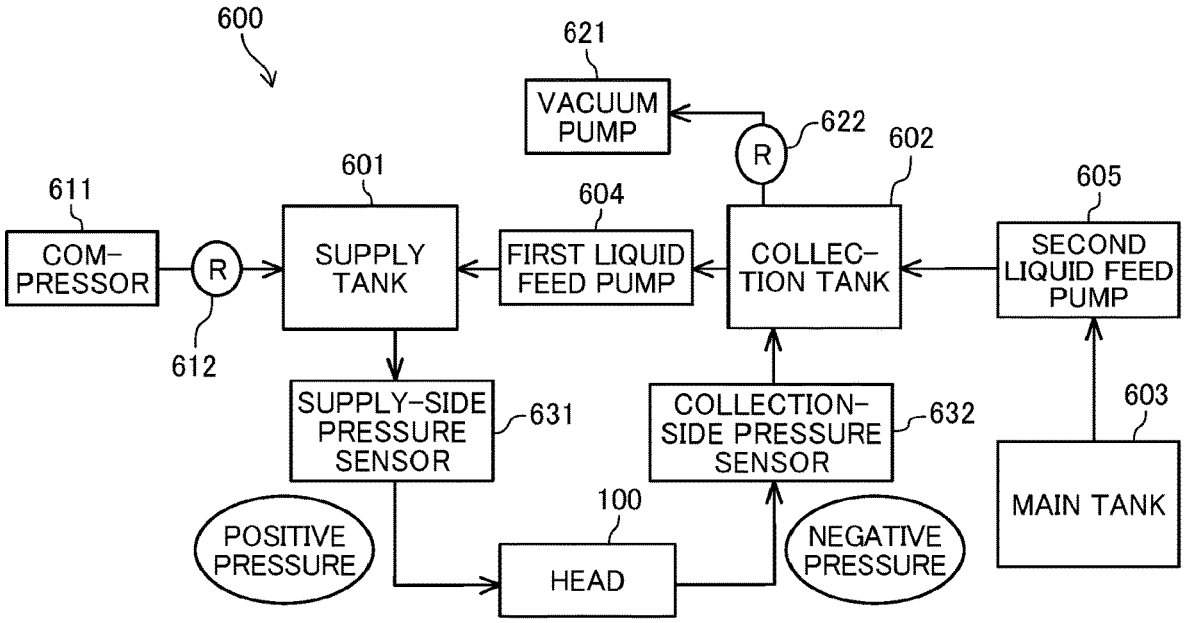
FIG. 8 is a block diagram of a liquid circulation device according to an embodiment of the present disclosure.

Next, a description is given below of a liquid circulation device according to an embodiment of the present disclosure, with reference to FIG. 8. FIG. 8 is a block diagram of the liquid circulation device according to the present embodiment. Although only one head is illustrated in FIG. 8, in a case in which a plurality of heads are arranged, a supply-side liquid path and a collection-side liquid path, respectively, are connected to the supply side and the collection side of a plurality of heads via, e.g., a manifold.

The liquid circulation device 600 includes, for example, a supply tank 601, a collection tank 602, a main tank 603, a first liquid feed pump 604, a second liquid feed pump 605, a compressor 611, a regulator 612, a vacuum pump 621, a regulator 622, a supply-side pressure sensor 631, and a collection-side pressure sensor 632.

The compressor 611 and the vacuum pump 621 together generate a pressure difference between the supply tank 601 and the collection tank 602.

The supply-side pressure sensor 631 is disposed between the supply tank 601 and the head 100 and connected to a supply-side liquid path connected to a supply port 71 of the head 100. The collection-side pressure sensor 632 is disposed between the head 100 and the collection tank 602 and connected to a collection-side liquid path connected to a collection port 72 of the head 100.

One end of the collection tank 602 is connected to the supply tank 601 via the first liquid feed pump 604, and the other end of the collection tank 602 is connected to the main tank 603 via the second liquid feed pump 605.

Accordingly, the liquid flows into the head. 100 from the supply tank 601 through the supply port 71, is collected to the collection tank 602 from the collection port 72, and is sent from the collection tank 602 to the supply tank 601 by the first liquid feed pump 604, thereby forming a circulation path through which the liquid circulates.

Here, the compressor 611 is connected to the supply tank 601 and is controlled so that a predetermined positive pressure is detected by the supply-side pressure sensor 631. On the other hand, the vacuum pump 621 is connected to the collection tank 602 and is controlled so that a predetermined negative pressure is detected by the collection-side pressure sensor 632.

Thus, the negative pressure of the meniscus can be kept constant while the liquid is circulated through the head 100.

When the liquid is discharged from the nozzles 11 of the head 100, the amount of liquid in the supply tank 601 and the collection tank 602 decreases. Therefore, the liquid is appropriately replenished from the main tank 603 to the collection tank 602 using the second liquid feed pump 605.

The timing of liquid replenishment from the main tank 603 to the collection tank 602 can be controlled based on, for example, the detection result of a liquid level sensor provided in the collection tank 602. In such a case, for example, liquid replenishment may be performed when the liquid level of the liquid in the collection tank 602 falls below a predetermined height.

Figure 9:
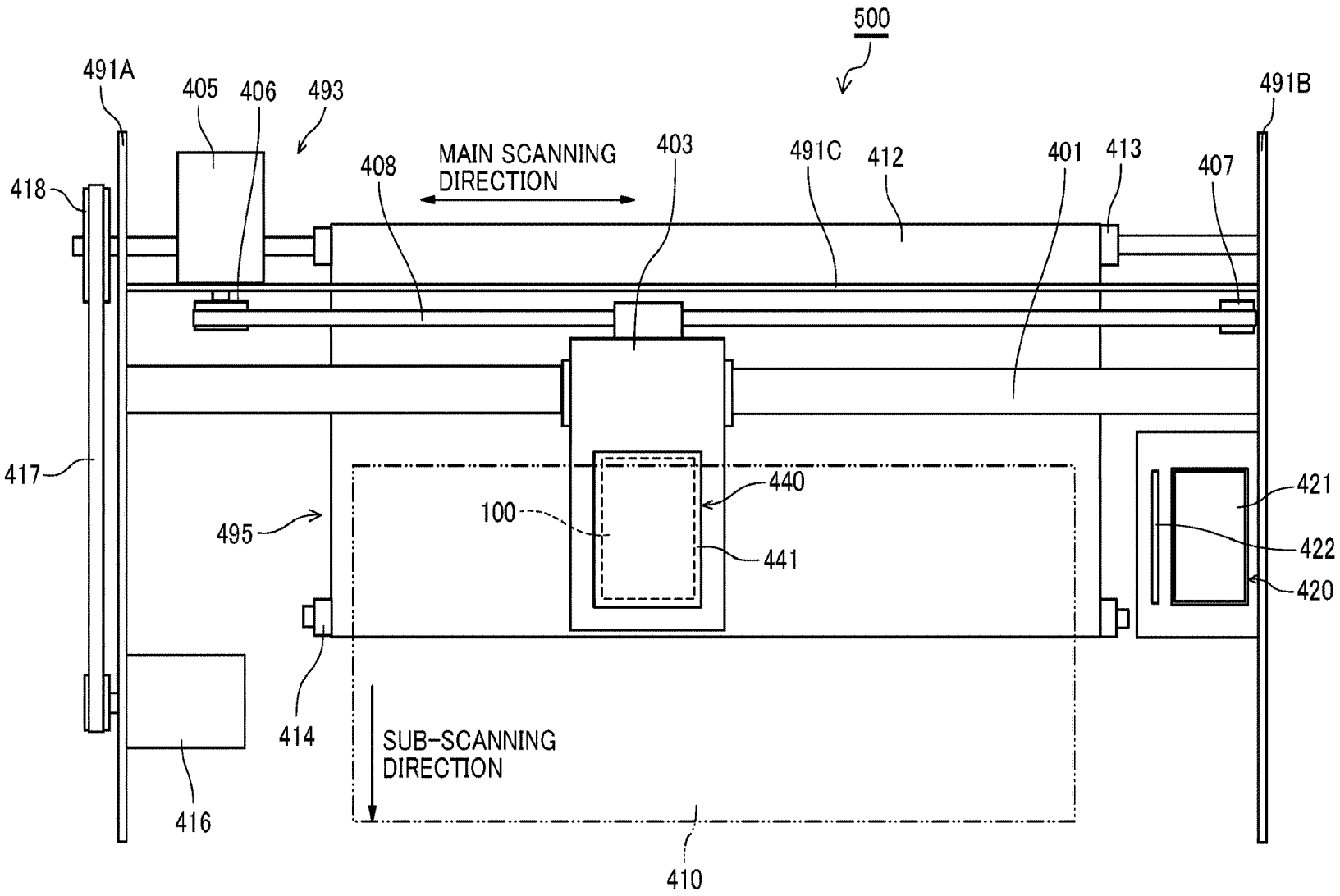
FIG. 9 is a plan view of a main part of a liquid discharge apparatus according to an embodiment of the present disclosure.
Figure 10:
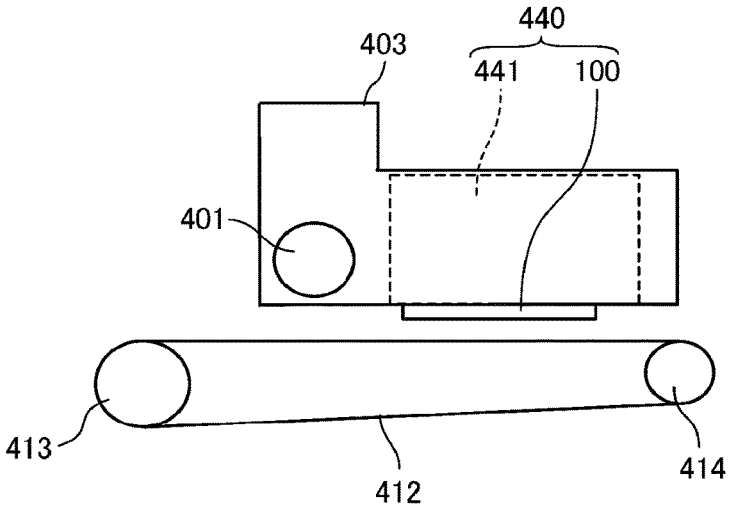

Next, a printing apparatus as a liquid discharging apparatus according to another embodiment of the present disclosure is described with reference to FIGS. 9 and 10. FIG. 9 is a plan view of a main part of a liquid discharge apparatus according to an embodiment of the present disclosure. FIG. 10 is a side view of the main part of the liquid discharge apparatus of FIG. 9.

A printing apparatus 500 serving as the liquid discharge apparatus according to the present embodiment is a serial-type apparatus in which a main-scanning moving mechanism 493 reciprocates a carriage 403 in main scanning directions indicated by arrow MSD in FIG. 9. A main-scanning moving mechanism 493 includes, e.g., a guide 401, a main-scanning motor 405, and a timing belt 408. The guide 401 is bridged between left and right side plates 491A and 491B to moveably hold the carriage 403. The main-scanning motor 405 reciprocates the carriage 403 in the main-scanning directions MSD via the timing belt 408 bridged between a drive pulley 406 and a driven pulley 407.

A discharge device 440 is mounted on the carriage 403. In the discharge device 440, a liquid discharge head 100 and a head tank 441 according to an embodiment of the present disclosure are integrated. The liquid discharge head 100 of the discharge device 440 discharges color liquids of, for example, yellow (Y), cyan (C), magenta (M), and black (K). The liquid discharge head 100 is mounted on the carriage 403 such that a nozzle row including a plurality of nozzles is arranged in a sub-scanning direction indicated by arrow SSD in FIG. 9 perpendicular to the main scanning direction MSD and a direction of discharge of color liquid is downward.

The liquid discharge head 100 is connected to the liquid circulation device 600 described above, and liquid of desired colors is circulated and supplied.

The printing apparatus 500 includes a conveyance mechanism 495 to convey a sheet 410. The conveyance mechanism 495 includes a conveyance belt 412 serving as a conveyor and a sub-scanning motor 416 to drive the conveyance belt 412.

The conveyance belt 412 attracts the sheet 410 and conveys the sheet 410 to a position facing the liquid discharge head 100. The conveyance belt 412 is an endless belt stretched between a conveyance roller 413 and a tension roller 414. The sheet 410 can be attracted to the conveyance belt 412 by electrostatic attraction, air suction, or the like.

The conveyance belt 412 circumferentially moves in the sub-scanning direction SSD as the conveyance roller 413 is rotationally driven by the sub-scanning motor 416 via a timing belt 417 and a timing pulley 418.

On one side of the carriage 403 in the main scanning direction MSD, a maintenance mechanism 420 that maintains and recovers the liquid discharge head 100 is disposed lateral to the conveyance belt 412.

The maintenance mechanism 420 includes, for example, a cap 421 to cap a nozzle face (i.e., a face on which nozzles are formed) of the liquid discharge head 100 and a wiper 422 to wipe the nozzle face.

The main-scanning moving mechanism 493, the maintenance mechanism 420, and the conveyance mechanism 495 are installed onto a housing including the side plates 491A and 491B and a back plate 491C.

In the printing apparatus 500 having the above-described configuration, the sheet 410 is fed and attracted onto the conveyance belt 412 and conveyed in the sub-scanning direction SSD by the circumferential movement of the conveyance belt 412.

The liquid discharge head 100 is driven in response to an image signal while moving the carriage 403 in the main scanning direction MSD to discharge the liquid onto the sheet 410 not in motion, thereby recording an image.

Figure 11:
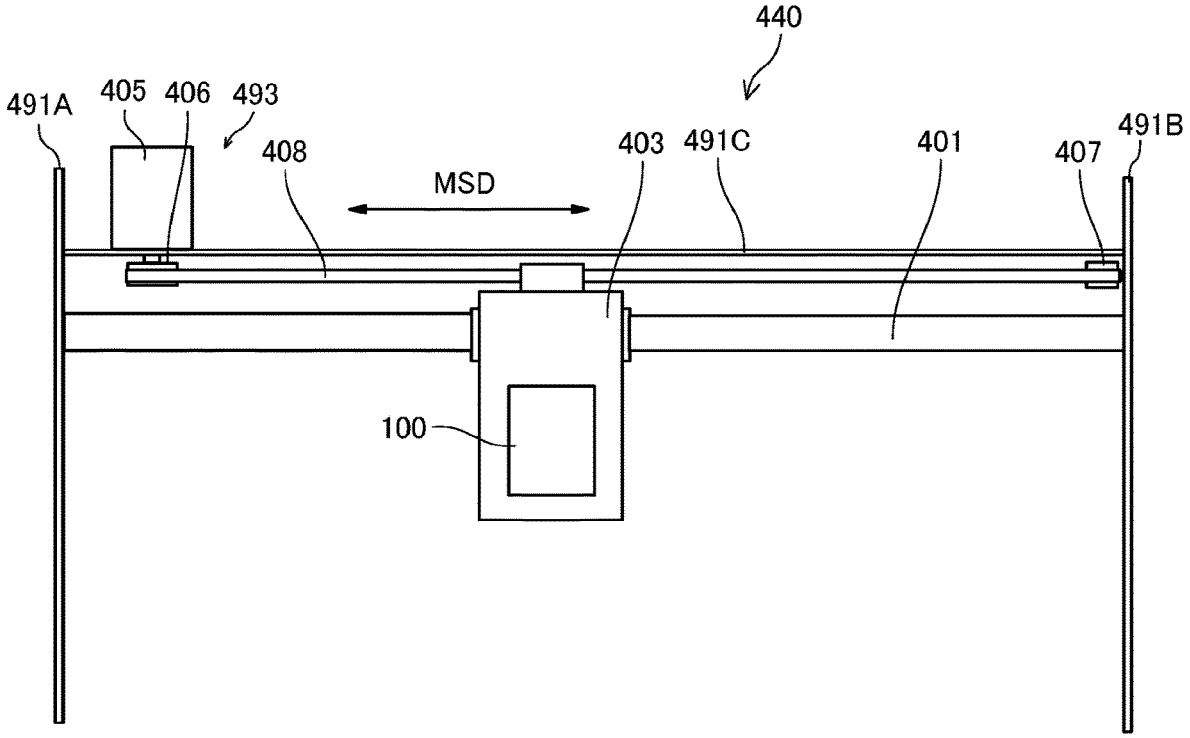
FIG. 11 is a plan view of a main part of a discharge device according to an embodiment of the present disclosure.

Next, a discharge device according to another embodiment of the present disclosure is described below with reference to FIG. 11. FIG. 11 is a plan view of a main part of the discharge device according to the present embodiment.

A discharge device 440 according to the present embodiment includes a housing including side plates 491A and 4918 and a back plate 4910, a main-scanning moving mechanism 493, a carriage 403, and a liquid discharge head 100, among the components or members of the printing apparatus 500 described above.

Note that a discharge device may have a configuration in which the above-described maintenance mechanism 420 is further attached to, for example, the side plate 491B of the discharge device 440.

Figure 12:
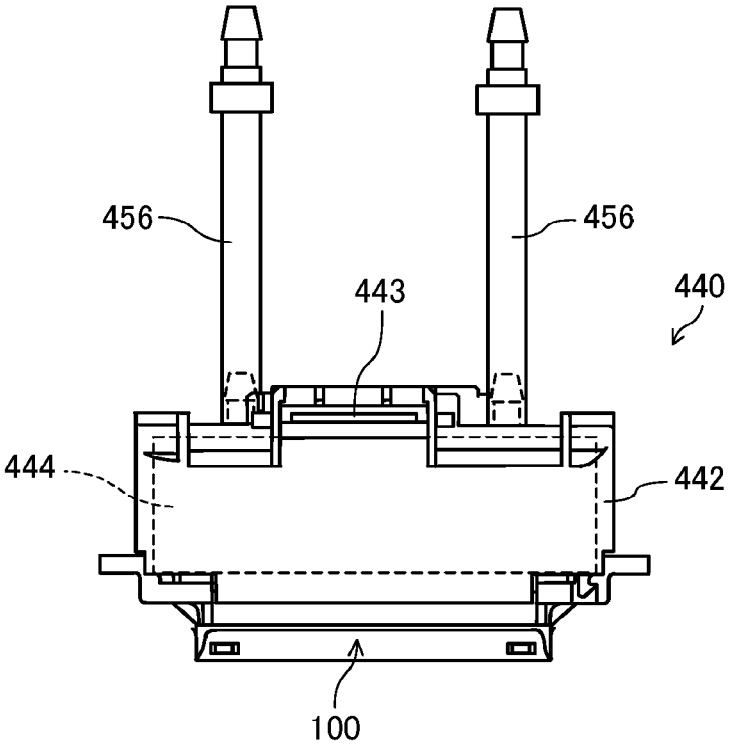
FIG. 12 is a front view of a discharge device according to an embodiment of the present disclosure.

Next, a discharge device according to still another embodiment of the present disclosure is described below with reference to FIG. 12. FIG. 12 is a front view of a main part of the discharge device according to the present embodiment.

The discharge device 440 illustrated in FIG. 12 includes a liquid discharge head 100 to which a channel component 444 is attached, and a tube 456 connected to the channel component 444.

The channel component 444 is disposed inside a cover 442. In some embodiments, the discharge device 440 may include the head tank 441 instead of the channel component 444. A connector 443 for electrically connecting to the liquid discharge head 100 is provided on the channel component 444.

In the present disclosure, discharged liquid is not limited to a particular liquid as long as the liquid has a viscosity or surface tension to be discharged from a head. However, preferably, the viscosity of the liquid is not greater than 30 mPa s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The discharge device is an integrated unit including the liquid discharge head and a functional part(s) or unit(s) and is an assembly of parts relating to liquid discharge. Examples of the discharge device include a combination of a liquid discharge head with at least one of a head tank, a carriage, a supply mechanism, a maintenance mechanism, a main-scanning moving mechanism, and a liquid circulation device.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head, functional component, and mechanism may also be detachably attached to one another.

For example, the liquid discharge head and the head tank are integrated as the discharge device. Alternatively, the liquid discharge head may be coupled with the head tank through a tube or the like to integrally form the discharge device. Here, a unit including a filter may further be added to a portion between the head tank and the liquid discharge head of the discharge device.

Examples of the discharge device further include discharge devices in which a liquid discharge head and a carriage are integrated.

Examples of the discharge device include a discharge device in which a liquid discharge head is movably held on a guide member constituting part of a scanning movement mechanism, and the liquid discharge head and the scanning movement mechanism are integrated. Examples of the discharge device include discharge devices in which a liquid discharge head, a carriage, and a main-scanning moving mechanism are integrated as a single unit.

Examples of the discharge device further include discharge devices in which a liquid discharge head, a carriage, and a maintenance mechanism are integrated in such a manner that the liquid discharge head is mounted on the carriage and a cap of the maintenance mechanism is secured to the carriage.

Examples of the discharge device further include discharge devices in which tubes connected to a head tank or a liquid discharge head mounted with a channel member so that the liquid discharge head and a supply mechanism are integrated as a single unit. Through the tubes, the liquid of a liquid storage source such as an ink cartridge is supplied to the head.

Examples of the main-scanning moving mechanism include a single guide. The supply mechanism may be a tube(s) only or a loading unit alone.

The term "liquid discharge apparatus" used herein also represents an apparatus including a head or a discharge device to drive the head to discharge liquid. The liquid discharge apparatus may be, for example, an apparatus capable of discharging liquid to a material to which liquid can adhere or an apparatus to discharge liquid toward gas or into liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the "material on which liquid can adhere" include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A liquid discharge head, comprising:

a nozzle plate including a plurality of nozzles configured to discharge liquid;

a channel plate including a plurality of pressure chambers communicated with the plurality of nozzles, respectively;

a common supply channel communicated with the plurality of pressure chambers, the common supply channel including a displaceable first region in a part of a wall of the common supply channel;

a common collection channel communicated with the plurality of pressure chambers, the common collection channel including a displaceable second region in a part of a wall of the common collection channel; and an air chamber facing a surface of the first region and a surface of the second region, wherein the surface of the first region is opposite the common supply channel, the surface of the second region is opposite the wall of the common collection channel, and the first region and the second region are disposed farther from the nozzle plate than the channel plate in a direction perpendicular to a nozzle surface of the liquid discharge head.

2. The liquid discharge head according to claim 1, wherein a portion of the common supply channel and a portion of the common collection channel overlap in the direction perpendicular to the nozzle surface of the liquid discharge head, the first region and the portion of the common supply channel overlap each other, and the second region and the portion of the common collection channel overlap each other.

3. The liquid discharge head according to claim 1, wherein the common supply channel includes a portion overlapping the common collection channel in the direction perpendicular to the nozzle surface of the liquid discharge head.

4. The liquid discharge head according to claim 1, wherein the common collection channel includes a portion overlapping the common supply channel in the direction perpendicular to the nozzle surface of the liquid discharge head.

5. The liquid discharge head according to claim 1, further comprising an atmosphere communication path configured to communicate the air chamber with an atmosphere.

6. A discharge device, comprising the liquid discharge head according to claim 1.

7. A liquid discharge apparatus, comprising the discharge device according to claim 6.

8. A liquid discharge apparatus, comprising the liquid discharge head according to claim 1.

9. A liquid discharge head, comprising:

a nozzle plate including a plurality of nozzles configured to discharge liquid;

a channel plate including a plurality of pressure chambers communicated with the nozzles, respectively;

a common supply channel communicated with the pressure chambers;

a common collection channel communicated with the pressure chambers;

an air chamber located between the common supply channel and the common collection channel;

a first region separating the common supply channel from the air chamber; and a second region separating the common collection channel from the air chamber, wherein the air chamber, a part of the common supply channel, and the common collection channel overlap each other in a direction perpendicular to a nozzle surface of the liquid discharge head, and the first region and the second region are disposed farther from the nozzle plate than the channel plate in the direction perpendicular to the nozzle surface of the liquid discharge head.

10. The liquid discharge head according to claim 9, wherein the common collection channel includes a portion overlapping the common supply channel in the direction perpendicular to the nozzle surface of the liquid discharge head.

11. The liquid discharge head according to claim 9, further comprising an atmosphere communication path configured to communicate the air chamber with an atmosphere.

12. A discharge device, comprising the liquid discharge head according to claim 9.

13. A liquid discharge apparatus, comprising the discharge device according to claim 12.

14. A liquid discharge apparatus, comprising the liquid discharge head according to claim 9.

* * * * *